US009278786B2

(12) United States Patent
Vovan et al.

(10) Patent No.: US 9,278,786 B2
(45) **Date of Patent: *Mar. 8, 2016**

(54) CONTAINERS WITH TAMPER-EVIDENT FEATURES

(75) Inventors: Jane N. Vovan, Upland, CA (US); Leon D. Rosen, Santa Monica, CA (US)

(73) Assignee: Smart-Tab, LLC, Upland, CA (US)

( * ) Notice: Subject to any disclaimer, the term of this patent is extended or adjusted under 35 U.S.C. 154(b) by 177 days.

This patent is subject to a terminal disclaimer.

(21) Appl. No.: 13/374,365

(22) Filed: Dec. 23, 2011

(65) Prior Publication Data

US 2012/0241456 A1 Sep. 27, 2012

Related U.S. Application Data

(63) Continuation of application No. 13/065,436, filed on Mar. 22, 2011, now Pat. No. 8,272,526.

(51) Int. Cl.
*B65D 17/34* (2006.01)
*B65D 43/02* (2006.01)

(52) U.S. Cl.
CPC .... *B65D 43/0254* (2013.01); *B65D 2543/0062* (2013.01); *B65D 2543/00092* (2013.01); *B65D 2543/00296* (2013.01); *B65D 2543/00509* (2013.01); *B65D 2543/00546* (2013.01); *B65D 2543/00685* (2013.01); *B65D 2543/00731* (2013.01); *B65D 2543/00796* (2013.01); *B65D 2543/00842* (2013.01)

(58) Field of Classification Search
CPC ..... B65D 2543/00842; B65D 2543/00851; B65D 43/0254
USPC ..... 206/807; 215/255, 301, 305; 220/203.1, 220/212.5, 214, 254.1, 254.3, 254.5, 264, 220/270, 713, 789, 791, 793, 269, 323; 49/460
See application file for complete search history.

(56) References Cited

U.S. PATENT DOCUMENTS

| | | | | | |
|---|---|---|---|---|---|
| 3,273,745 | A | * | 9/1966 | Stec | 220/231 |
| 3,460,701 | A | * | 8/1969 | Powalowski et al. | 215/10 |
| 3,656,648 | A | * | 4/1972 | Powaloski et al. | 215/253 |
| 3,690,499 | A | * | 9/1972 | Westfall et al. | 215/253 |
| 3,866,782 | A | * | 2/1975 | Westfall | 215/253 |
| 4,407,423 | A | * | 10/1983 | Walter | 220/260 |
| 4,431,110 | A | * | 2/1984 | Roth | 215/213 |
| 4,440,310 | A | * | 4/1984 | Heyn | 220/270 |
| 4,462,504 | A | * | 7/1984 | Roth et al. | 220/214 |
| 4,496,069 | A | * | 1/1985 | Winkless et al. | 220/260 |
| 4,519,517 | A | * | 5/1985 | Walter | 215/253 |
| 4,711,372 | A | * | 12/1987 | Gach | 222/23 |
| 4,742,935 | A | * | 5/1988 | Schellenberg | 220/791 |
| 4,778,072 | A | * | 10/1988 | Newman | 215/253 |
| 4,966,301 | A | * | 10/1990 | Yamashita et al. | 220/270 |
| 5,511,680 | A | * | 4/1996 | Kinne | 206/276 |
| 5,806,710 | A | * | 9/1998 | Shiffer et al. | 220/785 |

(Continued)

*Primary Examiner* — Fenn Mathew
*Assistant Examiner* — Chetan Chandra
(74) *Attorney, Agent, or Firm* — Todd L. Juneau

(57) ABSTRACT

A container has a lid that can be opened only by lifting and pulling a pull tab, with lifting of the pull tab resulting in an evident change. The pull tab is held down by attachment (interference fit, weld, glue) to a lid surface by a hold-down that is joined to the pull tab by a pair of bridges. When the pull tab is lifted, the bridges are broken. Thereafter, the pull tab springs up slightly from the lid plane, under the force of one or more spring walls and a hinge, which makes it evident that the container has been opened.

9 Claims, 15 Drawing Sheets

(56) References Cited

U.S. PATENT DOCUMENTS

| | | | | |
|---|---|---|---|---|
| 5,931,332 | A * | 8/1999 | Mygatt et al. | 220/270 |
| 6,688,486 | B2 * | 2/2004 | Diamond et al. | 220/785 |
| 6,883,678 | B2 * | 4/2005 | Chou | 220/793 |
| 7,073,680 | B2 | 7/2006 | Boback et al. | |
| 7,118,003 | B2 | 10/2006 | Sellari et al. | |
| 7,163,127 | B2 * | 1/2007 | Seelhofer | 222/83 |
| 7,870,979 | B2 * | 1/2011 | Maki et al. | 222/570 |
| 7,913,870 | B2 | 3/2011 | Vovan | |
| 8,186,531 | B2 | 5/2012 | Parikh et al. | |
| 8,608,008 | B2 | 12/2013 | Gingras | |
| 8,672,166 | B2 | 3/2014 | Nazareth | |
| 8,684,212 | B2 | 4/2014 | Stone et al. | |
| 8,757,416 | B2 | 6/2014 | Golota et al. | |
| 8,795,580 | B2 | 8/2014 | Sellari et al. | |
| 8,807,385 | B1 | 8/2014 | Fosse | |
| 8,939,307 | B2 | 1/2015 | Gingras | |
| 2005/0017007 | A1 | 1/2005 | Sellari et al. | |
| 2005/0184070 | A1 | 8/2005 | Boback et al. | |
| 2007/0075030 | A1 * | 4/2007 | Delli Venneri | 215/235 |
| 2008/0128443 | A1 * | 6/2008 | Coughlin et al. | 220/791 |
| 2008/0290091 | A1 * | 11/2008 | Shiffer et al. | 220/270 |
| 2009/0206082 | A1 * | 8/2009 | Vovan | 220/266 |
| 2009/0321463 | A1 * | 12/2009 | Vovan | 220/791 |
| 2010/0072217 | A1 | 3/2010 | Parikh et al. | |
| 2010/0102074 | A1 | 4/2010 | Parikh et al. | |
| 2010/0224630 | A1 | 9/2010 | Petlak | |
| 2010/0308052 | A1 * | 12/2010 | Zeiler et al. | 220/315 |
| 2011/0175261 | A1 | 7/2011 | Boback et al. | |
| 2012/0103990 | A1 | 5/2012 | McCumber | |
| 2012/0181280 | A1 | 7/2012 | Barbier | |
| 2013/0313275 | A1 | 11/2013 | Gingras | |
| 2014/0069922 | A1 | 3/2014 | Boback et al. | |
| 2014/0217100 | A1 | 8/2014 | Nazareth | |
| 2014/0284346 | A1 | 9/2014 | McCumber | |
| 2014/0300034 | A1 | 10/2014 | Sellari et al. | |
| 2014/0367383 | A1 | 12/2014 | Sellari et al. | |
| 2015/0008222 | A1 | 1/2015 | Pace | |
| 2015/0060456 | A1 | 3/2015 | Vovan | |
| 2015/0136777 | A1 | 5/2015 | Baillies | |
| 2015/0175315 | A1 | 6/2015 | Parikh et al. | |

* cited by examiner

CONTAINERS WITH TAMPER-EVIDENT FEATURES

CROSS-REFERENCE TO RELATED APPLICATIONS

The present application is a continuation application and claims the benefit under 35 U.S.C. §120 of the filing date of U.S. patent application Ser. No. 13/065,436 filed Mar. 22, 2011 now U.S. Pat. No. 8,272,526.

BACKGROUND

Consumer products and especially food, such as salads or grapes, is often sold in plastic containers, wherein a clerk at a store (who observes cleanliness standards) loads fresh food into a container and then closes it. Some customers are concerned that a person might have secretly opened the container to see if he/she likes the food, and then closed the container, leaving germs behind. Customers are assured of the integrity of the packaged food by constructing the container so if the container has been opened after the clerk loaded food into it, this fact will be evident. A container that was easy to open and reclose, and that indicated if it had been opened after the first time that it had been closed, and which could be constructed at low cost to produce a sturdy container, would be of value.

SUMMARY

Containers with tamper-evident features enables users to determine whether tampering has taken place on a container that has been filled with a product and sealed with a lid.

According to one aspect, a container includes a base, a lid engageable with the base, and a pull-tab assembly disposed on lid. The pull-tab assembly includes a holddown that is attachable to the lid and a pull tab that is pivotally attached to the lid and releasably attached to the holddown. The pull-tab assembly is configured such that when the holddown is attached to the lid and the pull tab is pulled away from the lid, the pull tab is detached from the holddown while the holddown remains attached to the lid. Accordingly, with the holddown remaining to the lid, a user is able to determine that the lid has been removed or at least tampered with.

According to another aspect, the pull-tab assembly may be defined as including a stowed position in which the holddown is attached to the lid and the pull tab is attached to the holddown, and a redeployed position in which the holddown is attached to the lid and the pull tab is detached from the holddown. To indicate tampering, the pull tab is prevented from being reattached to the holddown when in the redeployed position, Other features and advantages will become apparent to those skilled in the art from a consideration of the following detailed description taken in conjunction with the accompanying drawings.

DETAILED DESCRIPTION

Figure 1:
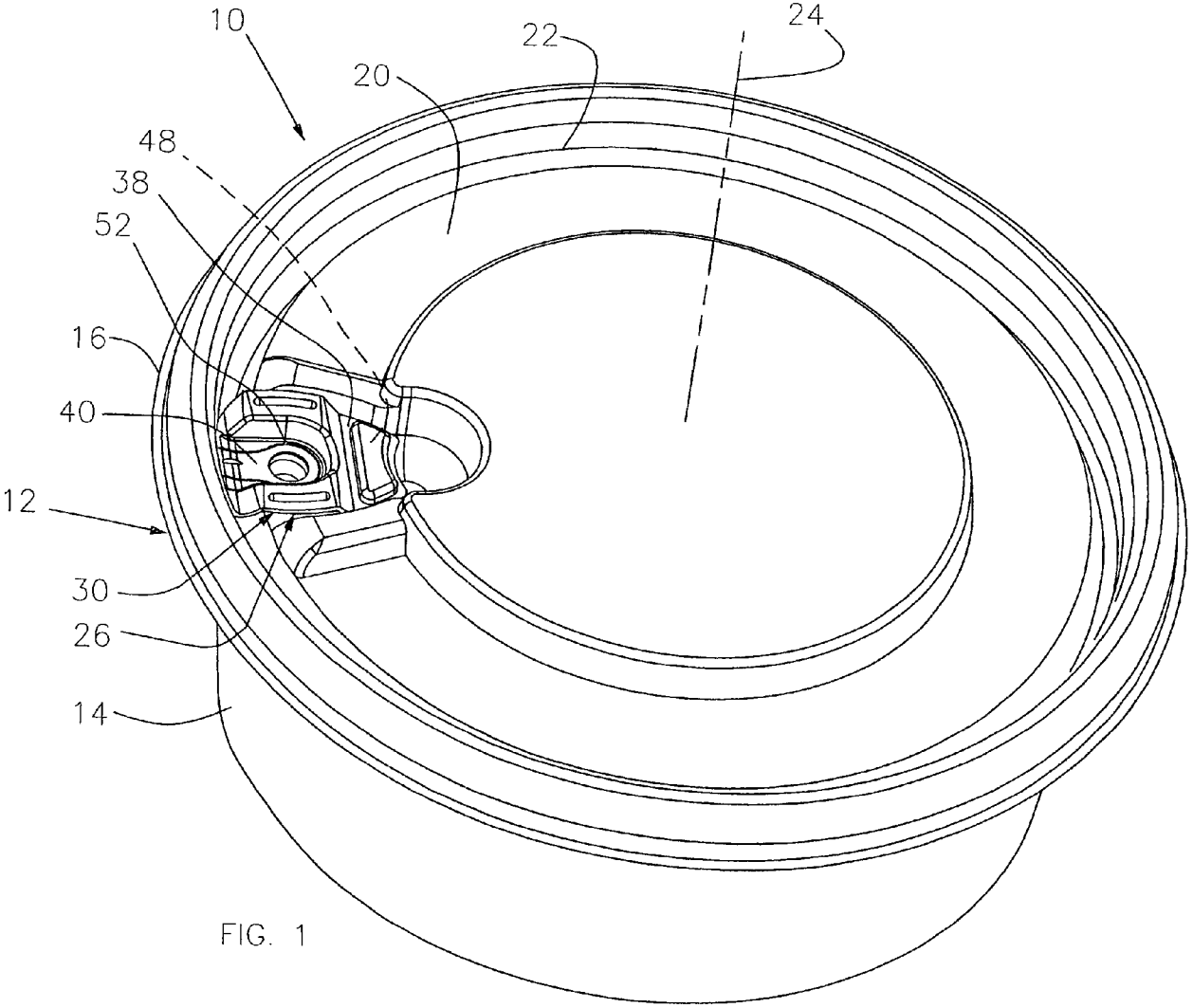
FIG. 1 is a top isometric view of a container of the invention, shown closed and with the pull tab in an initial stowed configuration, prior to a first opening by a customer.

FIG. 1 shows a container 10 of the invention which includes a base 12 that has a lower portion 14 that holds food or other articles or material, and that has an upper rim 16. The container also includes a lid 20 which closes an opening 17 (FIG. 2) at the top of the base. The lid and/or the base is formed of an easily deformable molded plastic, so the lid can be pulled forcefully out of the base, despite a lid flange 22 whose perimeter is concealed by the base. The base and lid lie on a vertical axis 24.

Figure 2:
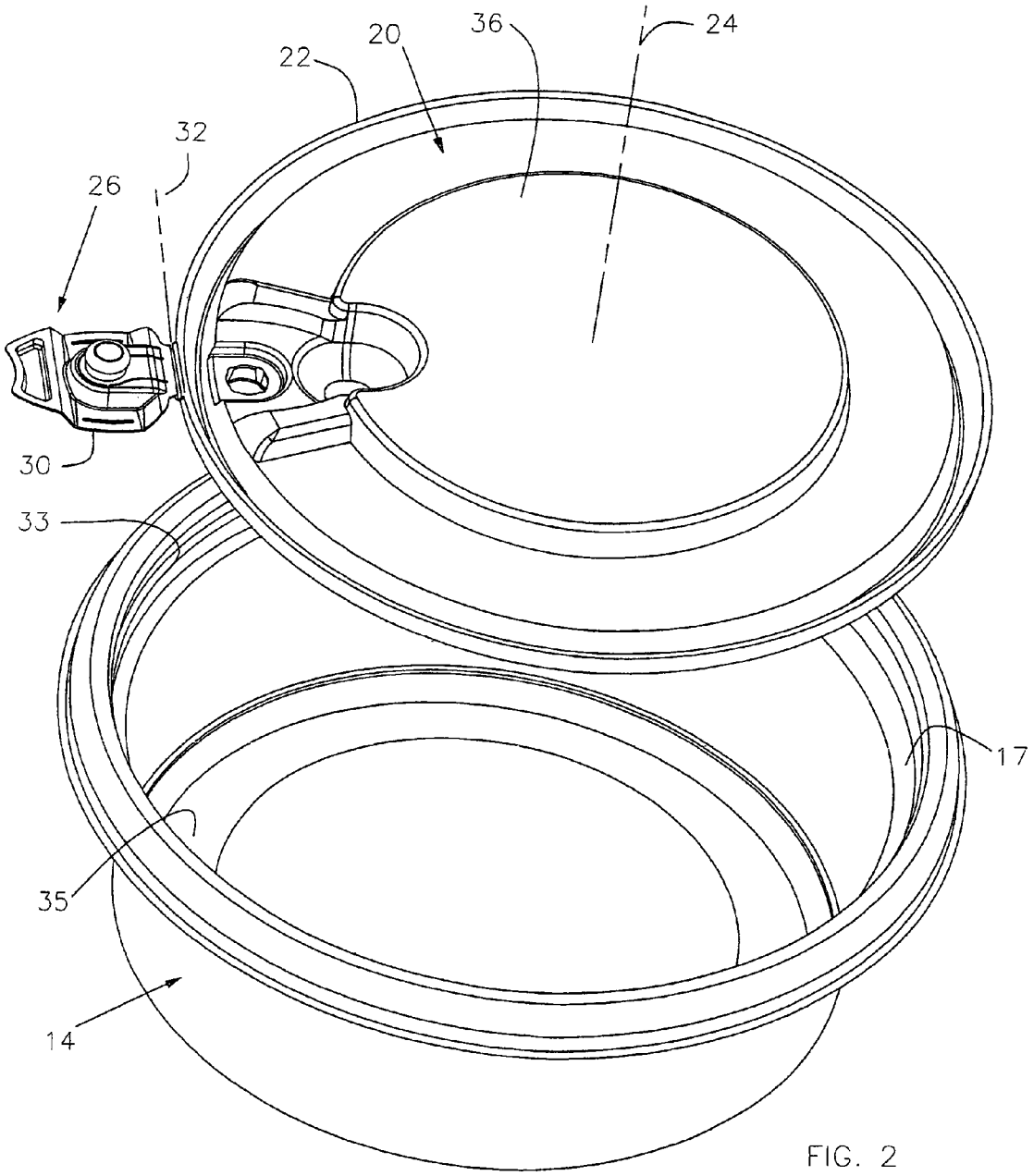
FIG. 2 is a view similar to that of FIG. 1, with the pull tab in an initial deployed position, as initially manufactured, and ready to be closed the first time, on the main lid part.

The lid includes a pull-tab assembly 26 that includes a holddown 40 and a pull tab 30. FIG. 2 shows the container as it is manufactured. The manufacturer ships the container with the pull-tab assembly 26 in the initial deployed position of FIG. 2 wherein the pull tab 30 has been pivoted by an angle J (FIG. 5) of more than 12° away from the initial stowed position of FIG. 1. In FIG. 2 the pull tab (as manufactured) is angled 180° from the initial stowed position of FIG. 1, so in FIG. 2 the pull tab 30 extends radially outward (away from axis 24) from its hinge axis 32. At a store or food distributor, a clerk loads the base with food and then moves the pull tab 30 to the initial stowed position of FIG. 1 wherein the pull tab 30 extends radially inward toward the hinge axis and at an angle J of less than 12° to the horizontal (usually less than 6°). Movement to the stowed position is done by a store clerk, by pivoting the pull-tab assembly 26 about a hinge pivot axis 32 (FIG. 2) from the initial deployed position shown in FIG. 2 to an initial stowed position shown in FIG. 1. In FIG. 2 the pull-tab assembly 26 projects from a circular periphery main lid portion 36.

The lid flange 22 is hidden because it lies in a groove 33 of the base, and the lid is removed by pulling up the pull tab. In the redeployed position of FIG. 5, the pull-tab assembly 26 can be pulled up to pull the lid 20 out of the base and thereby provide access to a base cavity 35 (FIG. 2) in the lower base portion 14. Afterwards, the pull-tab assembly 26 can be pivoted back toward the stowed position of FIG. 1 but not completely to the stowed position of FIG. 1. Once a customer pulls the pull tab to pivot it more than 12° toward the deployed position of FIG. 2, and then pivots the pull tab toward the stowed position of FIG. 1, it becomes evident that the container has been opened. This provides assurance to customers that if the pull-tab assembly appears to never have been opened, it has not been opened (after the store clerk first loaded food into it and closed the lid).

Figure 3:
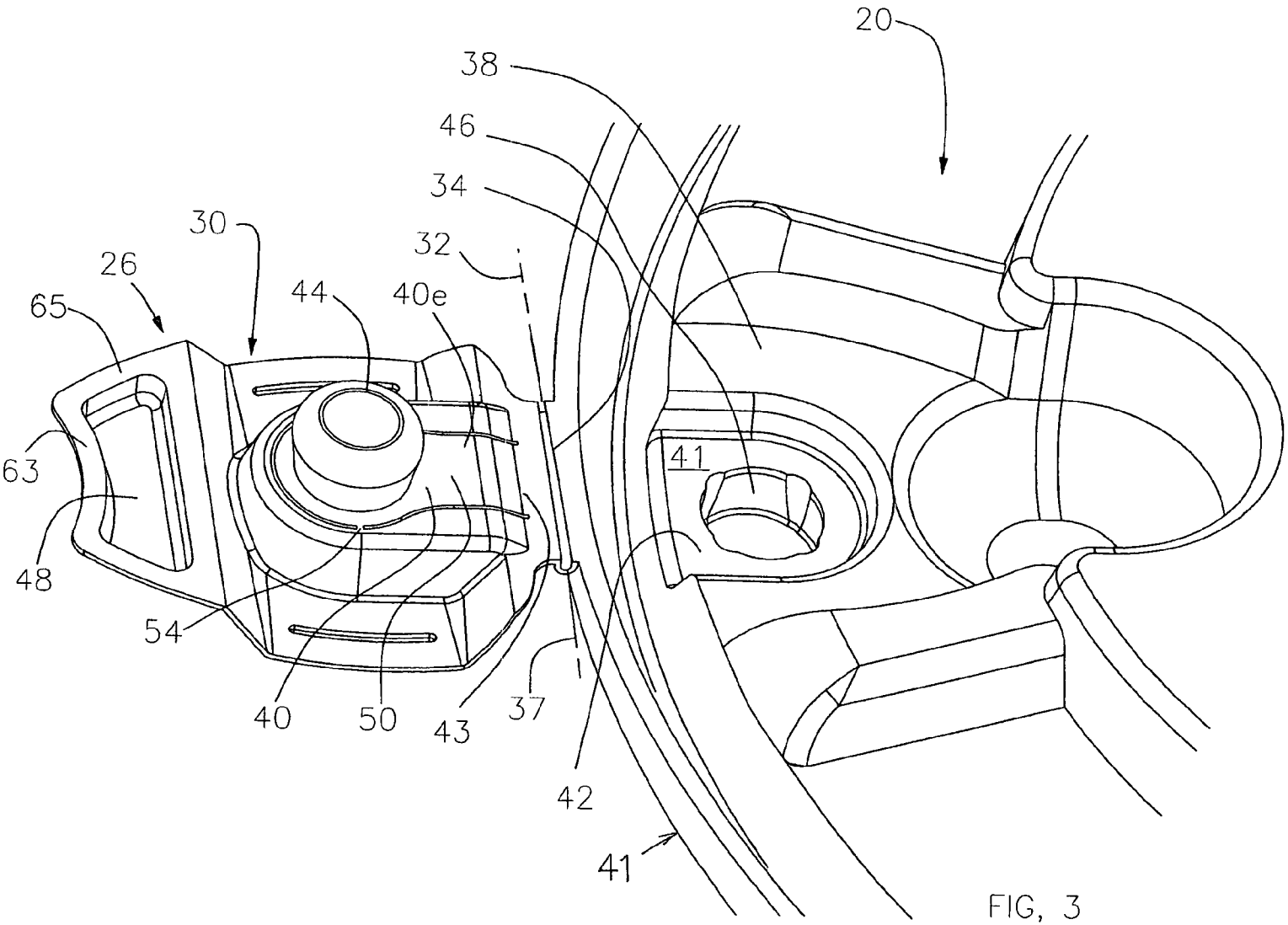
FIG. 3 is a partial isometric view of the lid of FIG. 2, with the pull tab in its initially deployed position and prior to the first time it is closed by a store clerk and then opened by a customer.

FIG. 3 shows details of the pull-tab assembly 26, in its configuration as manufactured. The pull-tab assembly 26 includes a pull tab 30 joined by a hinge 34 to an edge portion 37 of the lid main portion to pivot about the hinge axis 32. The pull-tab assembly also has a holddown portion or holddown 40 that is connected at 43 to the main lid portion 36. The location 43 lies within ½ inch and preferably within ¼ inch of the hinge axis 32. The lid has a tab mount surface 42. The pull tab lies facewise against the mount surface 42 before a customer lifts the pull tab, and the pull tab lies directly above (at an angle J of at least 12° from the mount surface 42) when the container is reclosed. The pull tab is connected by a breakable joint in the form of a pair of bridges such as 54 to the pull tab 30. The holddown 40 includes a lock projection 44 that fits into a lock recess 46 in the lid. The lock parts 44, 46 lie in series with the bridges so breaking the bridges allows the pull tab to be lifted while the lock parts remain locked together. The holddown also includes a thin sheet portion 50 of plastic on which the lock projection 44 is initially formed. When the pull tab 30 is initially pivoted closed (stowed) on the lid as by a store clerk, to the position shown in FIG. 4, the lock projection 44 fits into the lock recess 46 and locks in position therein. The locking occurs due to an interference fit resulting from the lock recess and projection being undercut. Thereafter, the only way to release the pull tab 30 is to break a pair of bridges 52, 54 that join the pull tab 30 to the holddown 40. The pull tab is partially separated from the holddown by a through slot 85 that is interrupted by the bridges 52, 54 and the connection 43'.

When a customer wants to open the container after food has been loaded in by a store clerk and the lid 20 has been closed, the customer inserts a finger (e.g., the index finger) into a finger recess 60 (FIG. 4) so the person's finger lies under a tip part 62 of the pull tab 30. The person then pries up the tip part to pry up the pull tab 30 and break the bridges 52, 54. This separates the pull tab 30 from the holddown 40 (except at the holddown end 40*e* that lies adjacent to the hinge 34). The holddown 40 remains locked through the lock projection 44 and lock recess 46 to the main circular portion 36 of the lid. A customer can pull up the pull tab 30 to lift the lid off the base. The pull tab is formed with a recess 48 (FIG. 3) that lies adjacent to the tip 62. The recess 48 stiffens the end of the pull tab and makes it easier to tightly hold the pull tab without slipping.

Figure 4:
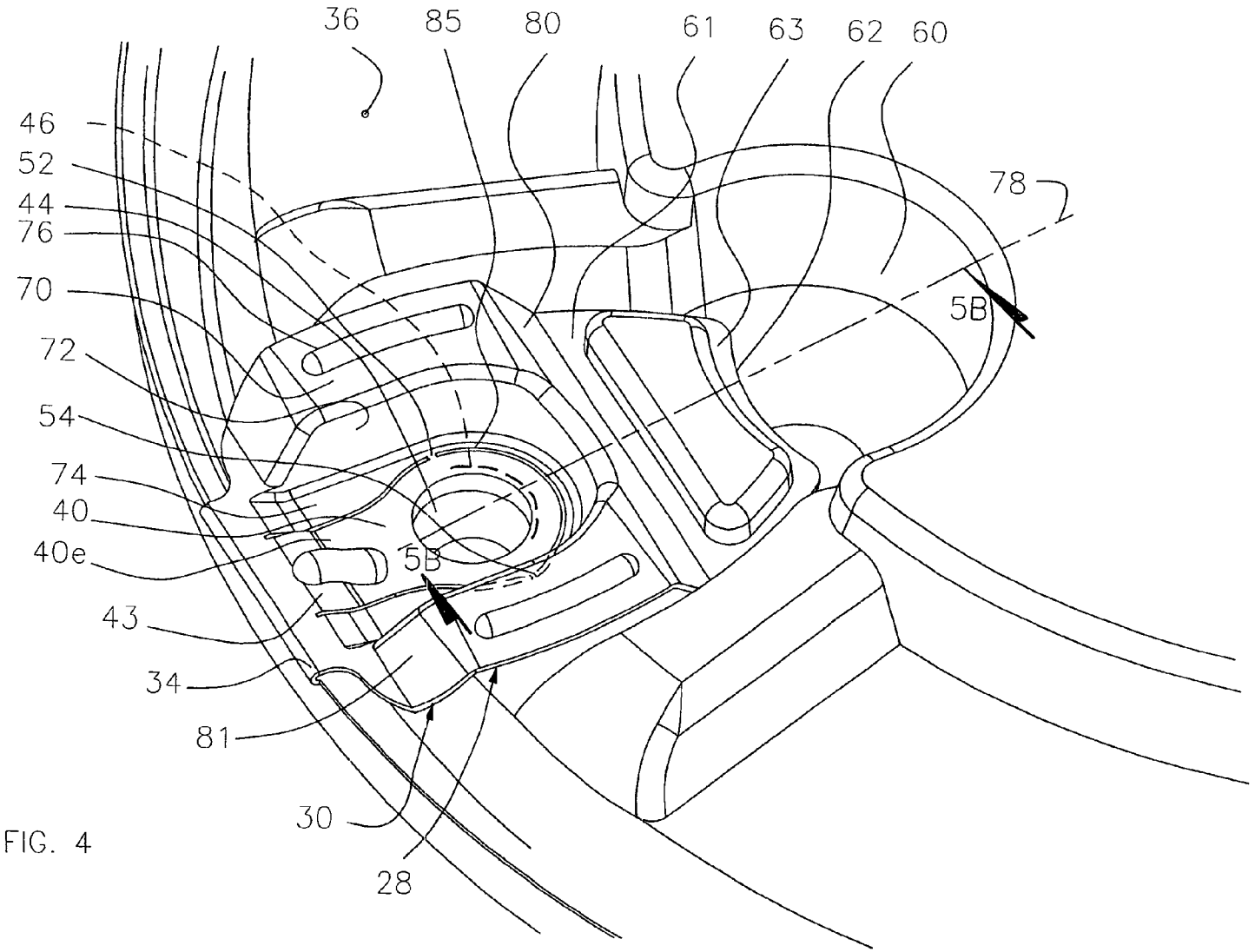
FIG. 4 is a partial isometric view of the area shown in FIG. 3, but with the pull tab in its initial stowed position, which it assumes prior to the first time the pull tab is opened by a customer.
Figure 5:
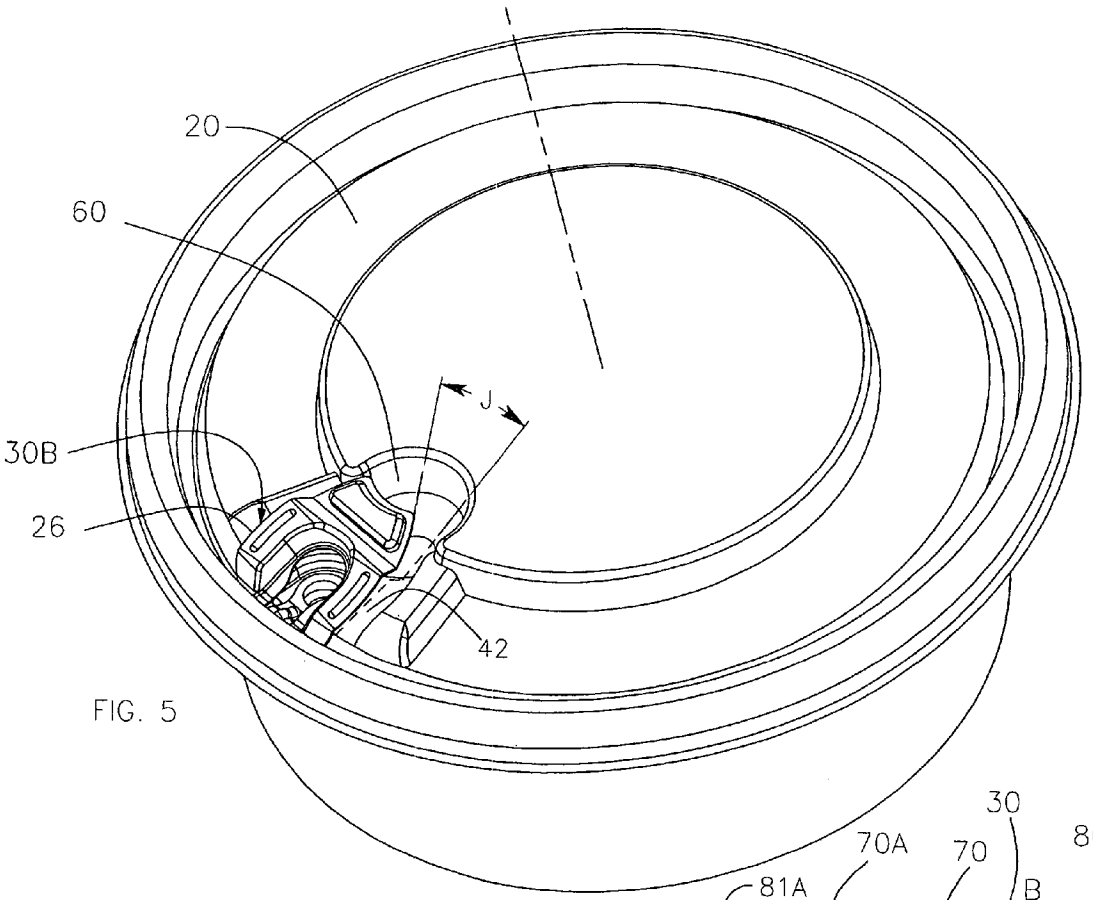
FIG. 5 is an isometric view of the area of FIG. 4, but with the pull tab in its re-stowed and evident-opened position, which it assumes the first time the pull tab is opened by a customer and then closed by the customer, showing how the tab indicates the fact that the container has been opened by a customer.

When a customer again closes the container, and pivots the pull tab 30 back toward its original position of FIG. 1, the pull tab surface 65 (FIG. 3) does not lie "flat" against a lid surface 38 (FIG. 3), but springs up slightly as to the position shown at 30B in FIG. 5. Two major phenomena keep the pull tab in a raised position such as in FIG. 5. These phenomena include the hinge 34 (FIG. 3) and the resilience of spring walls 80, 81 (FIG. 4). The resilience of the spring walls 80, 81 results in the pull tab moving upward (above the lid main portion 36 in FIG. 4) when the bridges 52, 54 are broken, while the holddown 40 does not move upward, so the pull tab 30 lies above the holddown.

The hinge 34 (FIG. 3) by which the pull tab 30 is connected to the lid does not tend to remain in the 180° folded position of FIG. 1, but tends to straighten by a plurality of degrees, preferably at least 6° and more preferably at least 12°, so the pull tab pivots up and is angled J by a plurality of degrees from a flat position, as shown in FIG. 5. After the bridges 52, 54 are broken, the holddown 40 is connected to the pull tab 30 only through the connection 43 (FIG. 3), which is close to the hinge axis 32 and therefore has little effect upon the position of the pull tab. The resilience of the hinge therefore urges the pull tab to pivot upward.

A plurality of spring walls, including walls 80, 81 (FIG. 4) raise the pull tab toward the raised position of FIG. 5. Applicant constructs the pull tab 30 (FIG. 4) with a raised periphery 70 (FIG. 4). The raised periphery 70 is supported on largely vertical inclined walls 72 extending at upward inclines from the pull tab bridge surface 74 (that connects to the bridges 52, 54) to the raised periphery 70. This stiffens the pull tab 30 against bending. The raised periphery 70 also has a pair of stiffening ridges 76 to resist bending. Thus, when the pull tab 30 is broken free of the holddown 40, except at the hinge 34, the pull tab 30 is a stiff member. Applicant notes that the pull tab 30 is symmetric about a radial line 78.

The raised periphery 70 (FIG. 4) connects through a radially-inward (toward axis 24) and downward inclined spring wall 80 to pull tab surface portions 61, 63. The pull-tab assembly is constructed so the spring wall 80 tends to raise the periphery 70 and the tab surface, although the bridge surface is initially held down through the bridges 52, 54 to the holddown 40. However, when the bridges 52, 54 are first broken, which occurs when a customer forcefully lifts the tip part 62, the spring wall 80 lifts the periphery 70 and the bridge surface 74. The tab surface 61 then lies above the holddown 40, and this is very apparent to customers.

Figure 5A:
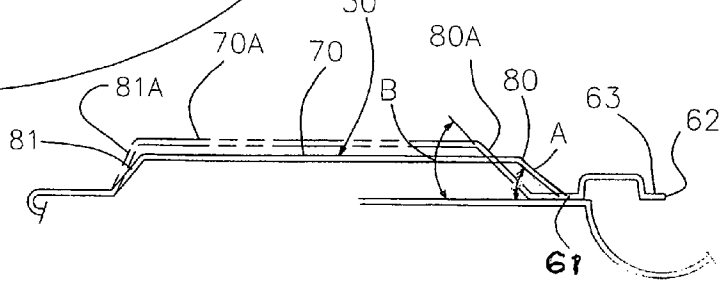
FIG. 5A is a simplified sectional view of the pull tab region of the container, showing it in two positions.

FIG. 5A shows that when the manufacturer first pivots the pull tab to the stowed position, the manufacturer pushes down the raised periphery from 70A to 70 so its angle from the horizontal moves from B to A. The pull tab is held in this position by the holddown 40 (FIG. 4). In this position the spring walls 80, 81 have been deflected toward the horizontal. When the pull tab is thereafter raised and the bridges 52, 54 to the holddown are broken, the pull tab will not return to the original factory position. Instead, the periphery 70 will rise to position 70A as the spring walls 80, 81 return toward more vertical positions 80A, 81A.

Figure 5C:
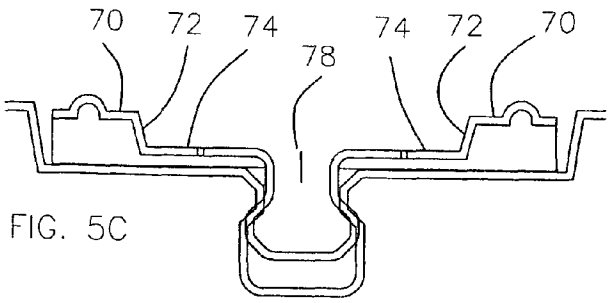
FIG. 5C through FIG. 5E are views taken on line 5D-5D of FIG. 6, showing the pull tab as it is being installed in the holddown, showing the pull tab as it appears when fully installed in the holddown by a store clerk, and showing the pull tab as it appears after the bridges have been broken by a customer.
Figure 5D:
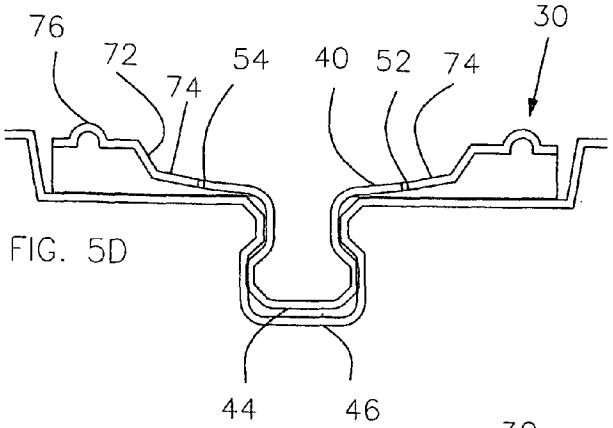
Figure 5E:
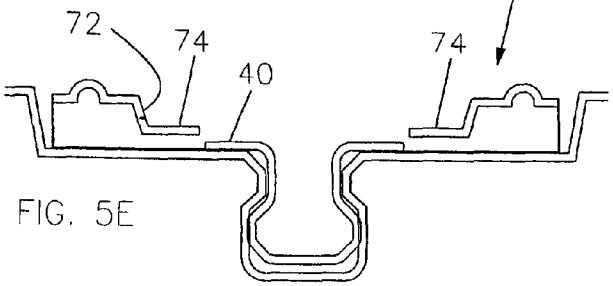
Figure 5B:
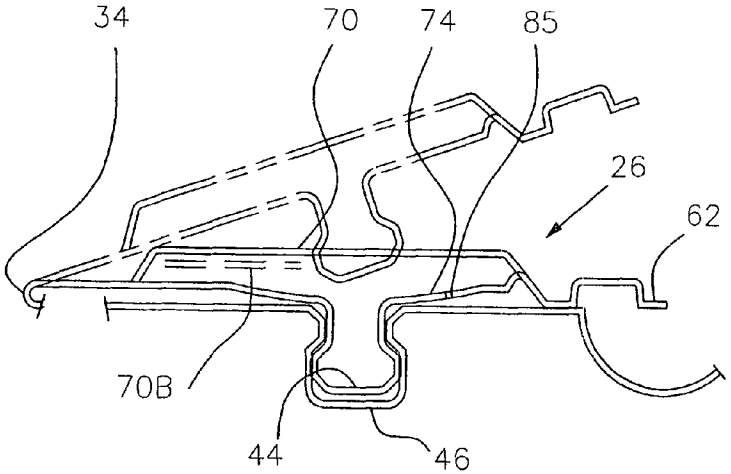
FIG. 5B is a view taken on line 5B-5B of FIG. 4, showing the pull tab periphery and bridge surface.

FIG. 5B is a view taken along line 5B-5B of FIG. 4, showing the pull-tab assembly 26 as a store clerk is depressing it. The pull-tab assembly is pressed down until the projection 44 is pressed into the undercut recess 46. During such pressing, the store clerk depresses the raised periphery 70 to position 70B, while also depressing the bridge surface 74. Afterward, the periphery tends to spring up to position 70B.

Figure 6:
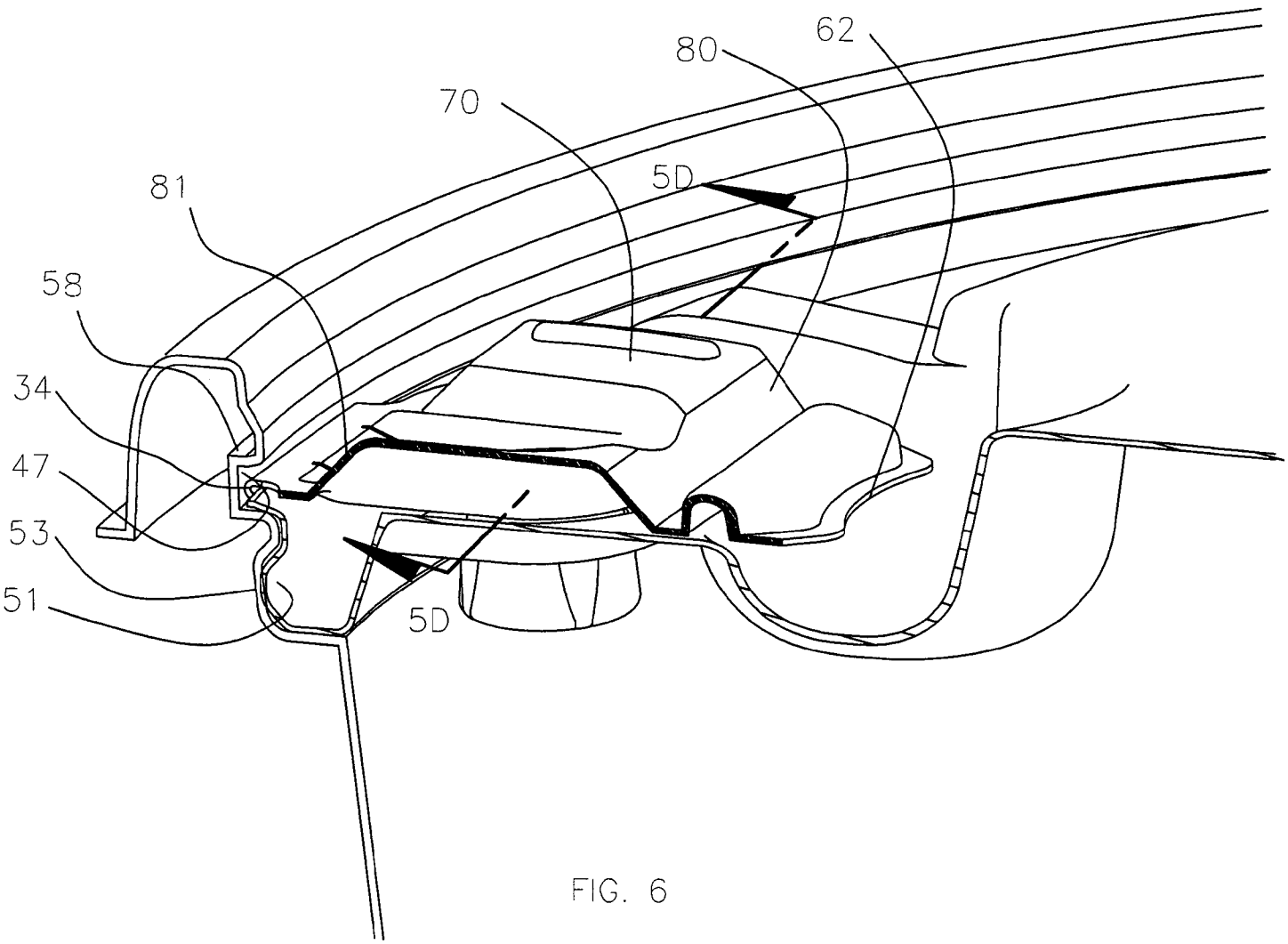
FIG. 6 is a sectional view of a portion of the container of FIG. 4, in its initial stowed position and prior to an opening by a customer.

FIG. 5C is a view taken on line 5D-5D of FIG. 6, showing the raised periphery 70 that lies on circumferentially opposite sides of a radial line 78, which is also shown in FIG. 4. FIG. 50 shows that opposite bridge surfaces 74 and the inclined walls 72 are also depressed and bent by the store clerk during initial installation. As the projection 44 is forced into the recess 46 to initially close, or stow, the pull tab, the bridge surfaces 74 are downwardly bend to depress the holddown 40. The bent bridge surfaces 74 are maintained in the downward bent configuration until a customer lifts the tip part 62 (FIG. 58) and breaks the bridges 52, 54. FIG. 5E shows that a person can see a gap between the holddown 40 and the bridge surface 74 of the pull tab after the bridges have been broken.

The pull tab is held to the main lid part through a breakable joint which includes the lock projection 44 (FIG. 3) that lies in an interference fit in the lock recess 46 and which is not a breakable part. The pull tab also includes the bridges 52, 54 that are breakable. Together they form a breakable joint.

Instead of using a lock projection 44 (FIG. 3) and lock recess 46 to initially hold the pull tab in the initial stowed position as supplied by the manufacturer, other holddown means can be used. It is possible to use a bonded joint, formed by a weld or adhesive, to fasten the holddown 40 to the lid main portion at 36 (FIG. 3) and use that as a breakable joint instead of the bridges 52, 54. In any case, it is desirable to lock the pull tab to lid main portion at 36 with the pull tab pressed downward against the mount surface 42, so the spring walls 80, 81 (FIG. 4) are deflected towards the horizontal and tend to spring back to be more vertical.

FIG. 6 is a view similar to FIG. 5A, and shows a cross-section of the container taken through the raised periphery 70. Applicant notes that the rim of the base and lid form a convex seal 51 on the lid that abuts a concave seal 53 formed by the base. The base forms a radially inward-opening recess 47 that receives the hinge 34 that is formed by the lid. Walls of the recess 47 form an overhang 58 that deters tampering.

Figure 7:
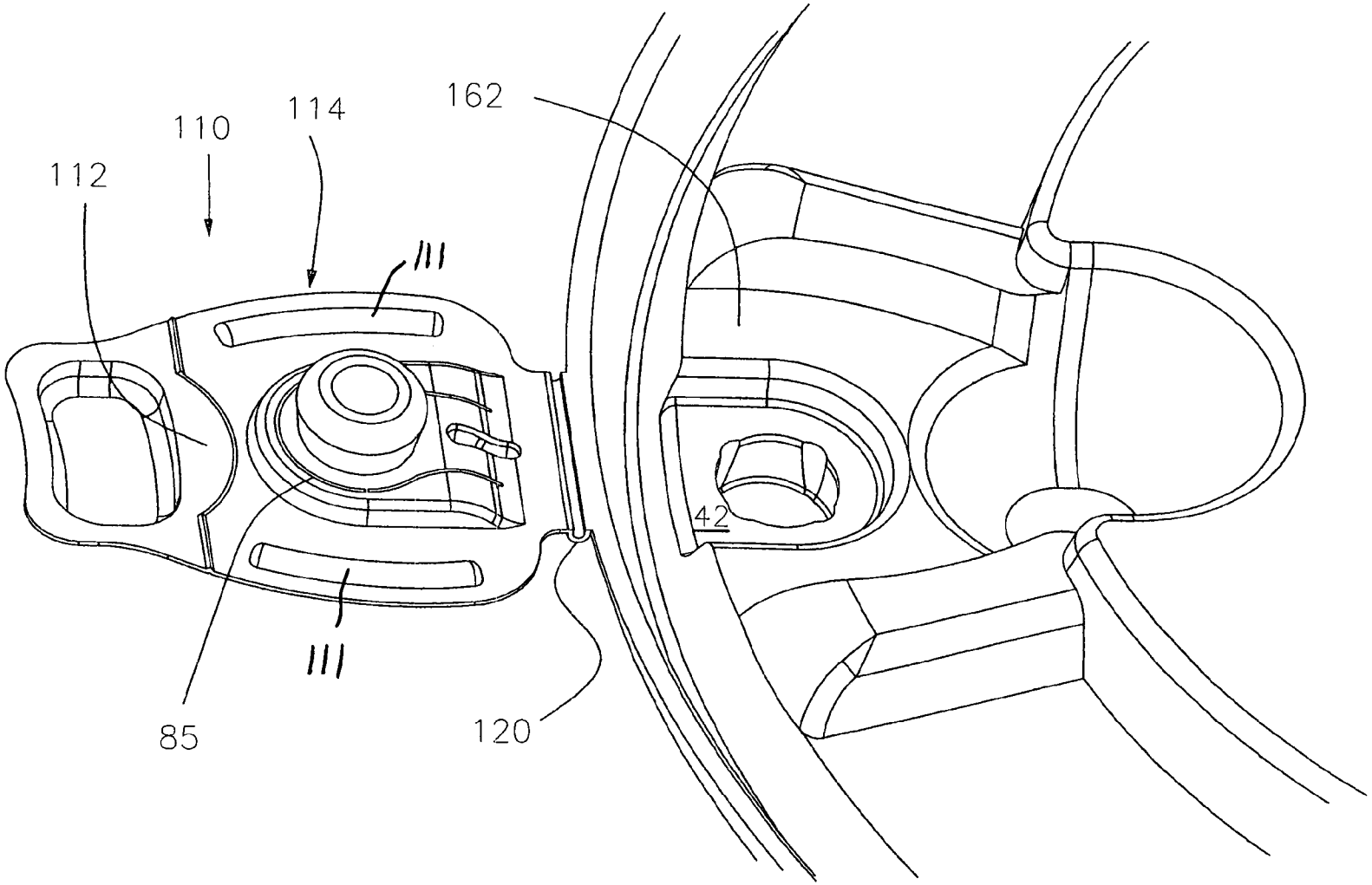
FIG. 7 is a top isometric view of a portion of a container of another embodiment of the invention, as manufactured and in its initial deployed position.
Figure 8:
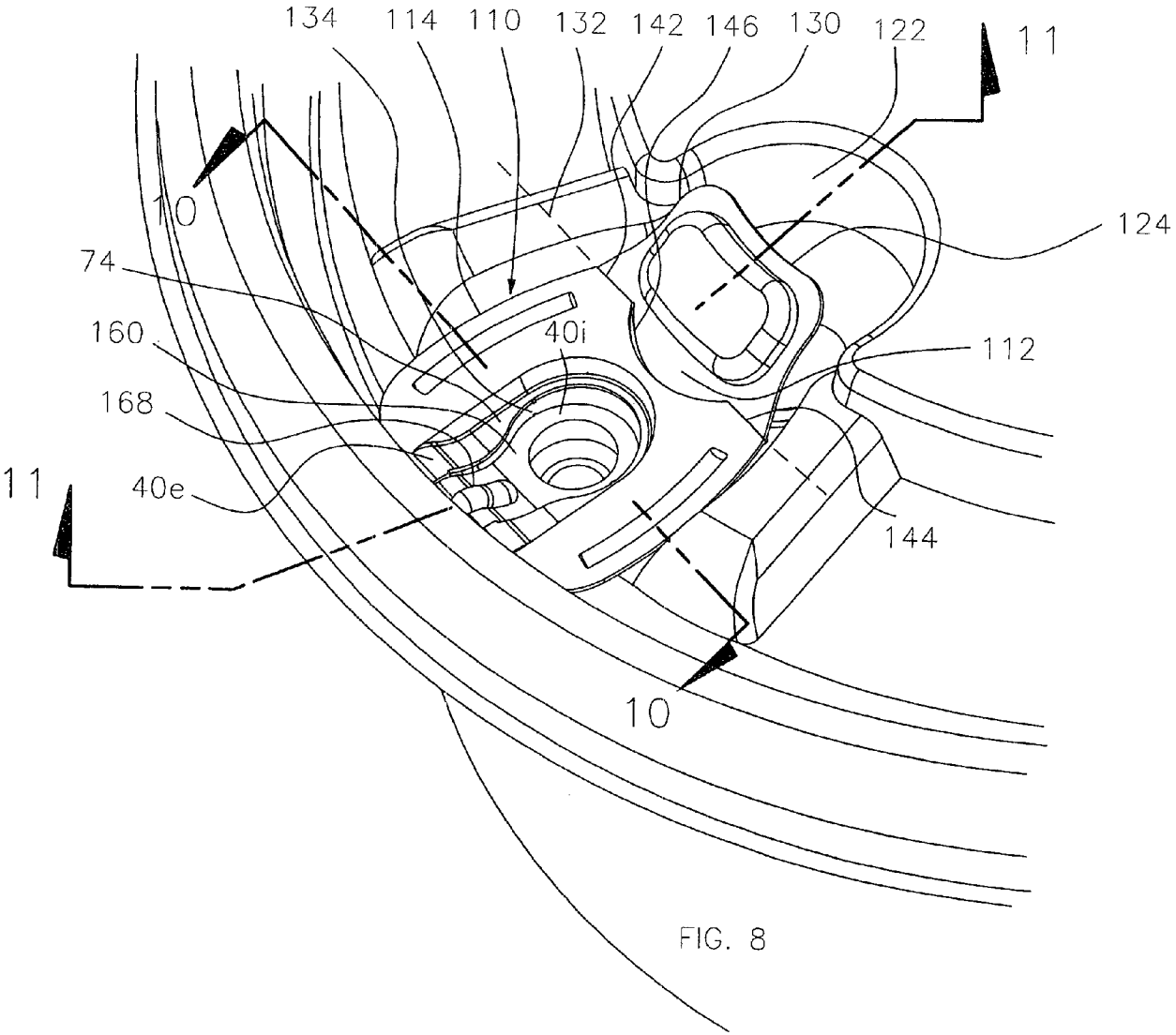
FIG. 8 is a view similar to FIG. 7, but showing the container after the pull tab has been moved to an initial stowed position and when the tip region has been partially lifted.

FIG. 7 shows another embodiment of the invention, wherein a pull-tab assembly 110 has a spring wall 112 that raises the pull tab 114 after a first opening. The pull-tab assembly 110 includes a hinge 120 that connects to a pull tab 114. At a factory, the pull-tab assembly 110 is pivoted about hinge 120 to a closed, or stowed position wherein the pull tab 114 lies over the lid main portion 121 at an angle of less than 12° (preferably less than 6°) to the lid main portion surface. FIG. 8 shows the pull-tab assembly 110 in the initial stowed position to which a store clerk has positioned the pull tab, except that a customer has then inserted his finger into the finger hole 122 and lifted the tip 124 of the pull tab. When the tip 124 has been lifted, a tip region 130 of the pull tab pivots about a pivot axis 132. The pull tab is scored along the axis 132 to weaken it at locations 142, 144 to pivot thereat, and is cut through along curved line 146 to form a radially outward projection of the spring wall 112. When the tip inner end region 130 is pivoted up (e.g., over 6°) by a customer to the raised position of FIG. 8, the spring wall projection 112 lifts the pull tab 110 and breaks a bridge 134. The next time a customer moves the pull tab to the restowed position, the spring wall 112 prevents the pull tab from lying "flat" so the pull tab is raised (preferably by at least 12°).

Figure 9:
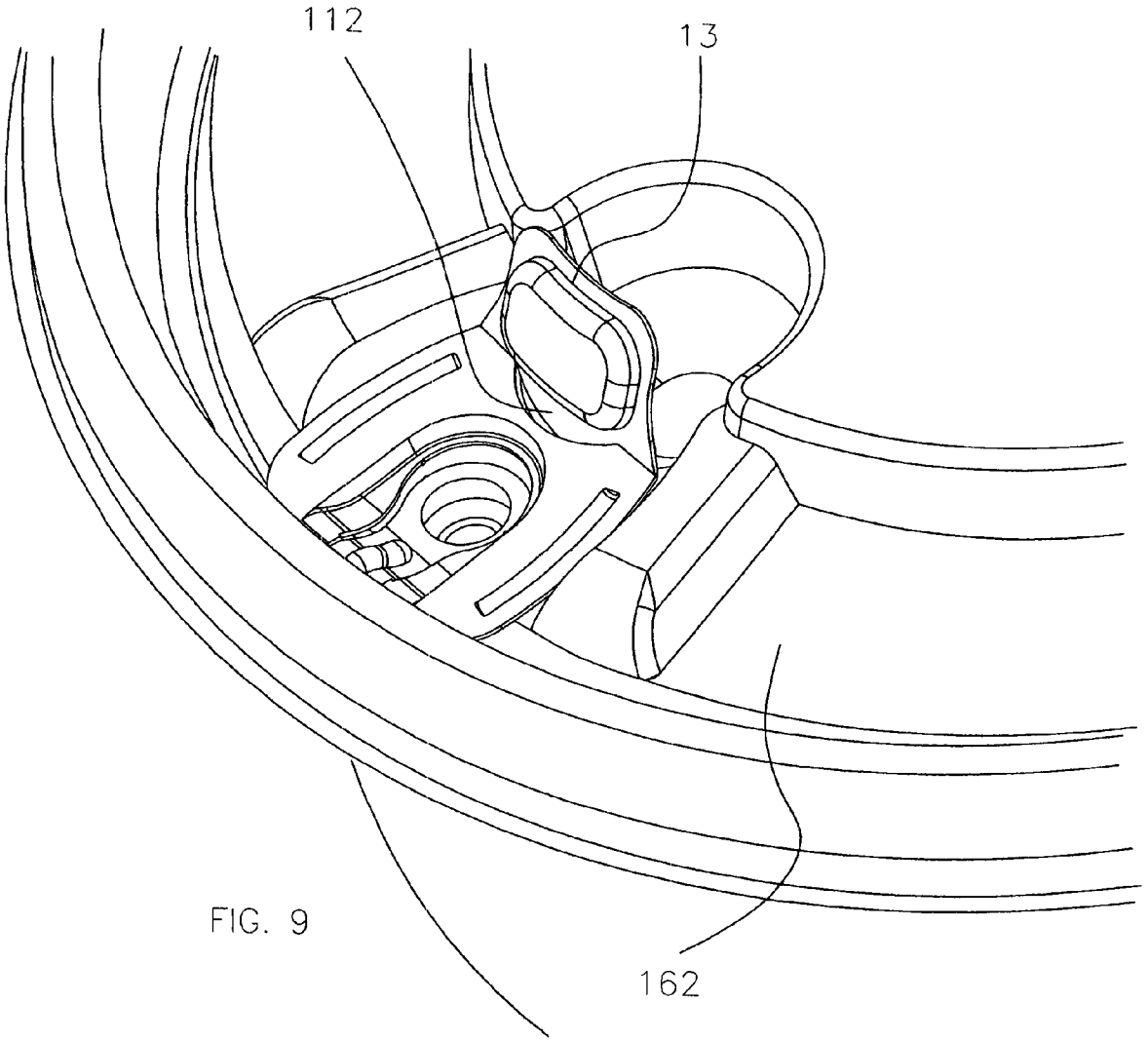
FIG. 9 is a view similar to FIG. 8, after the tip region has been lifted by a customer.
Figure 10:
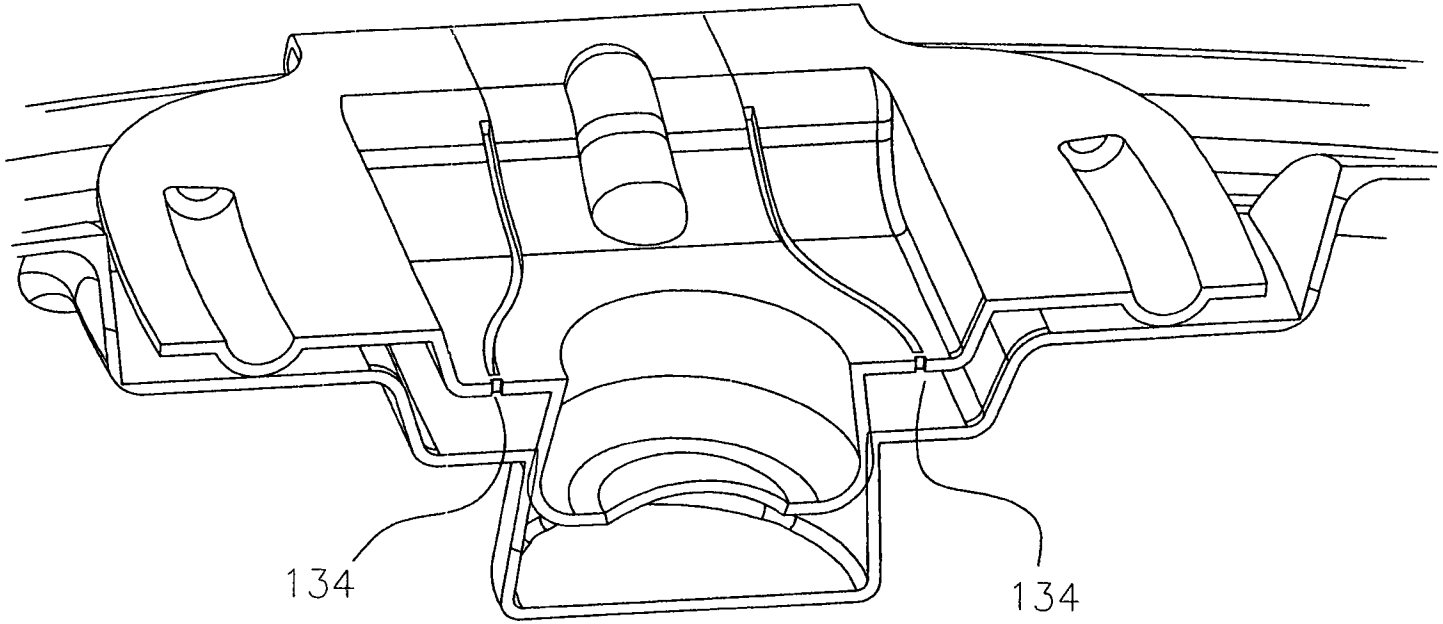
FIG. 10 is an isometric sectional view of the pull tab of FIG. 8 taken on line 10-10 of FIG. 8, prior to opening the container.
Figure 11:
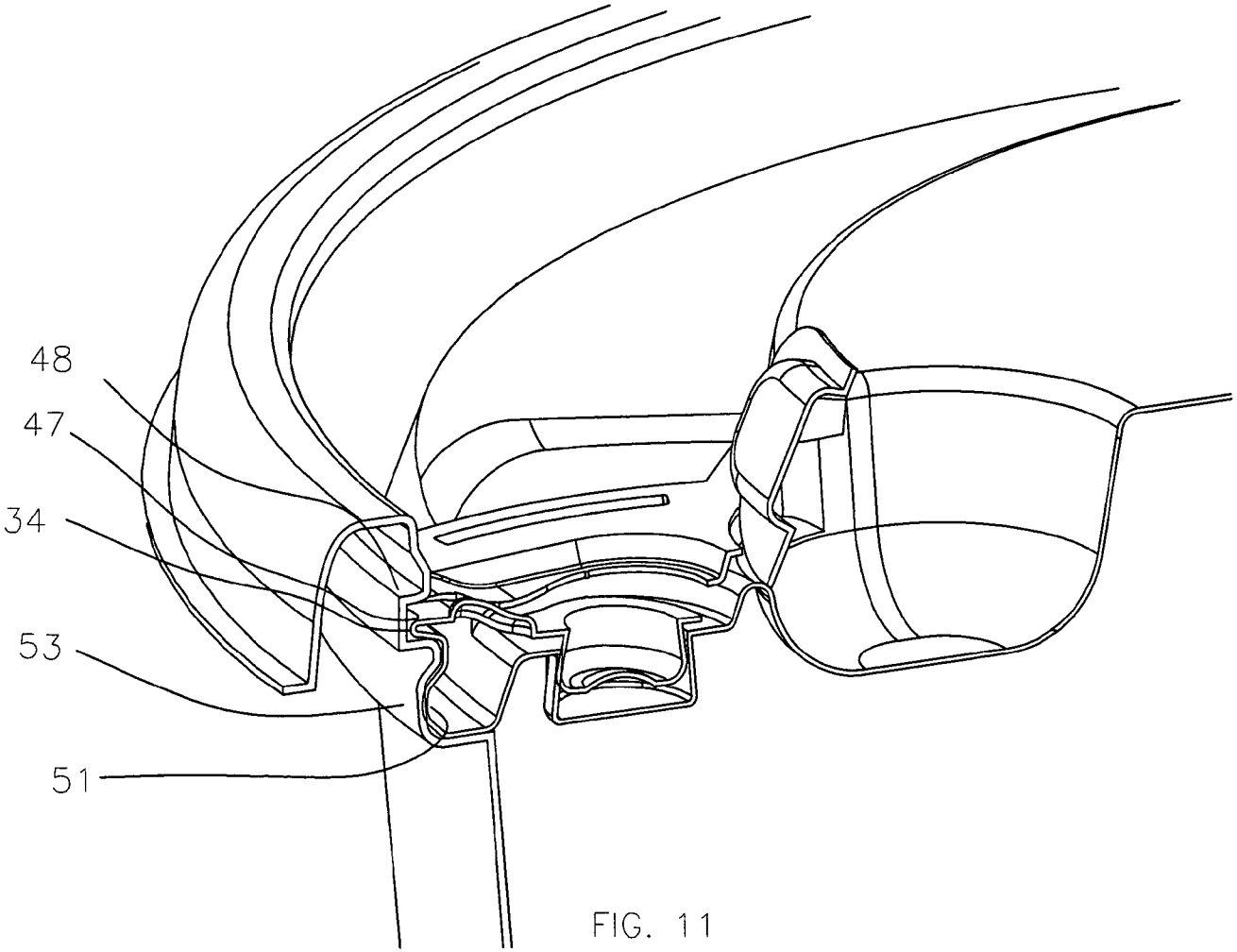
FIG. 11 is an isometric sectional view of the pull tab of FIG. 8, taken on line 11-11 of FIG. 8, when the tip region has been partially lifted.

The pull tab inner end, or tip region 130 is connected through bridge 134 to a flat holddown 160. When pull tab region 130 is lifted, it breaks the bridge 134. After the bridge is broken, the spring wall 112 keeps the pull tab lifted as shown in FIG. 9, with the spring wall 112 pressing against the lid main portion 162 and with the tip region 130 being raised.

FIG. 8 shows that the holddown 160 has a stiffening rib 168 at the radially outer end portion 40*e* of the holddown. The rib 168 prevents the holddown end portion 40*e* from bending up to place the radially inner end 40*i* of the holddown at the same level as the bridge surface 74 when a customer has not opened the container and restowed the pull tab.

Figure 12:
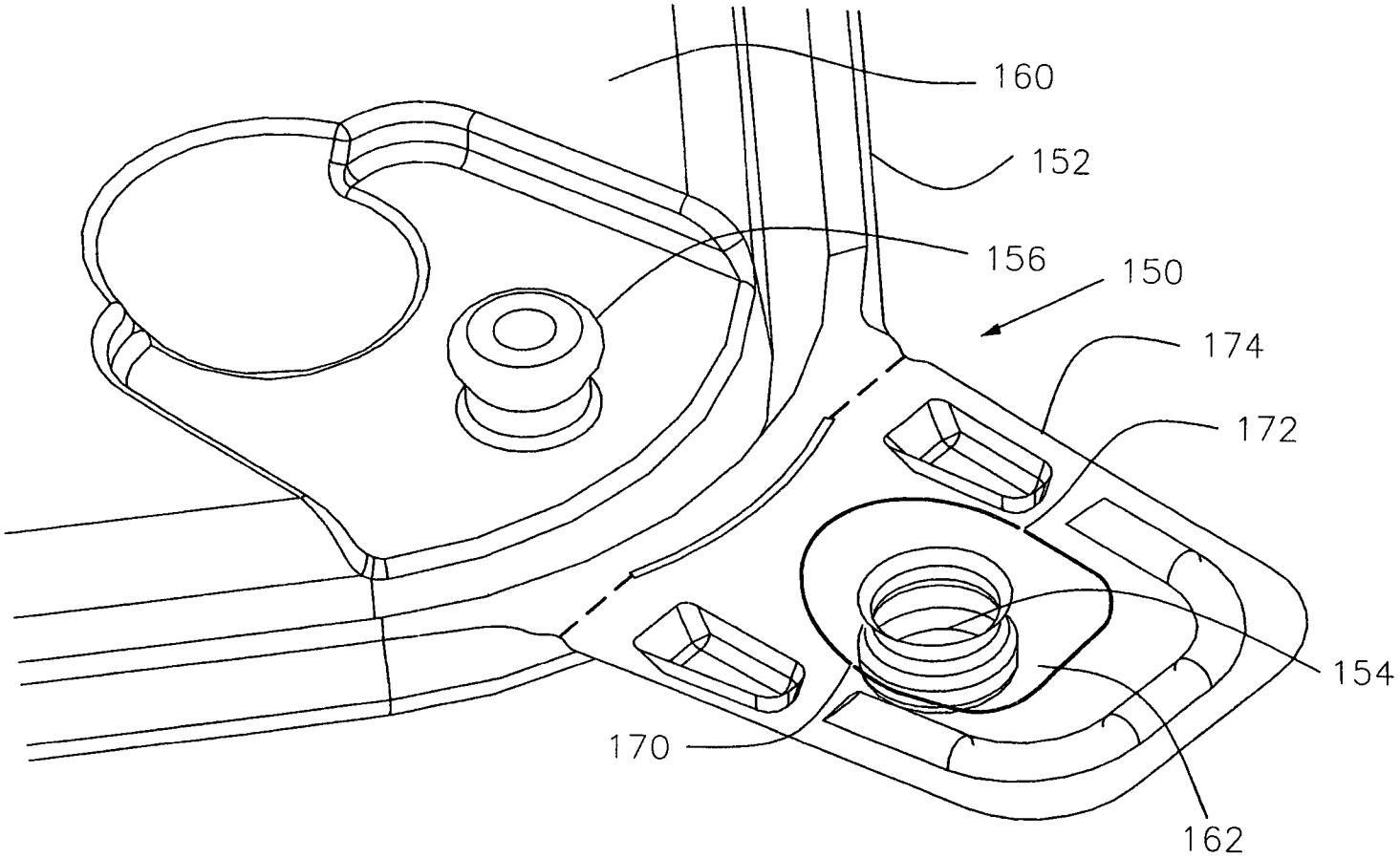
FIG. 12 is a partial isometric view of a portion of a rectangular container with a pull-tab assembly in the initial deployed position.
Figure 13:
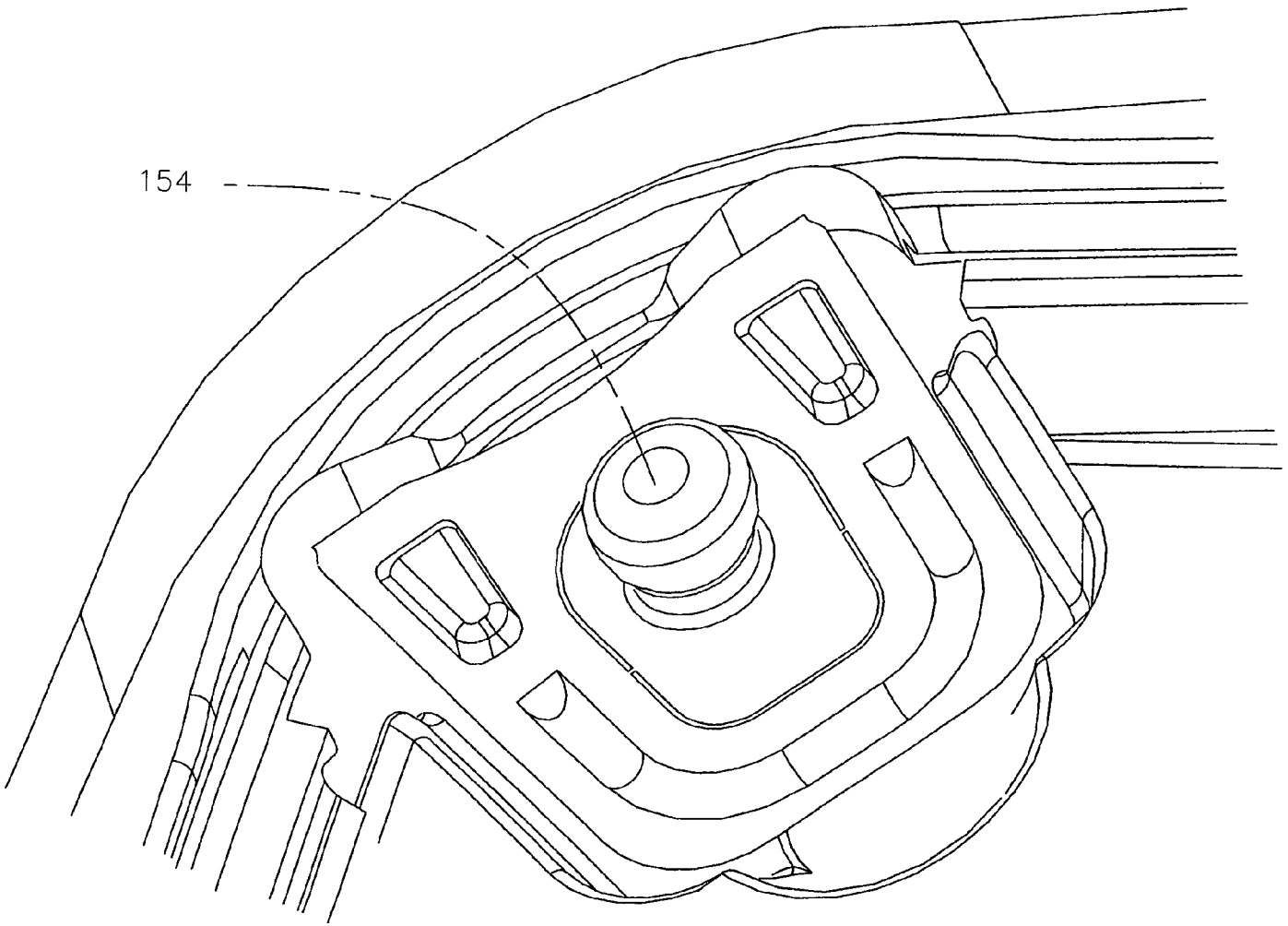
FIG. 13 is an isometric view of the embodiment of FIG. 12 with the pull tab in the initial stowed position.

FIGS. 12 and 13 show a pull-tab assembly 150 of a rectangular container 152 (with a vertical axis, not shown). In this container, the undercut lock recess 154 lies in the pull tab 174 and the projection 156 lies on the main lid portion 160. A holddown 162 on the pull-tab assembly 150 is joined by bridges 170, 172 to the pull tab 174.

Figure 14:
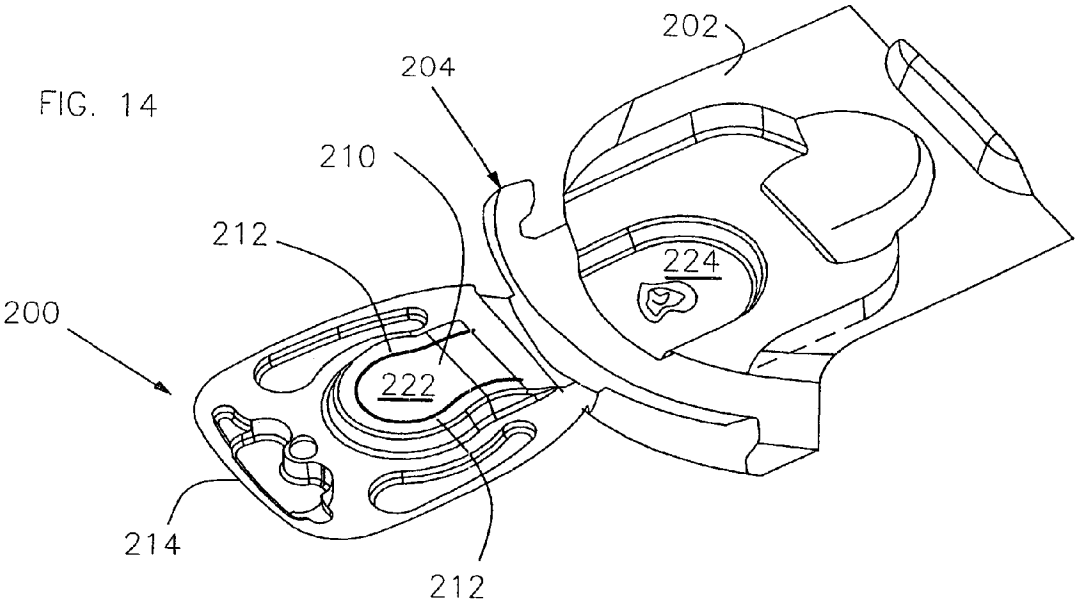
FIG. 14 is a partial isometric view of a container of another embodiment of the invention wherein the pull tab is designed to be bonded to the main lid portion and the pull tab is in its initial deployed position.
Figure 15:
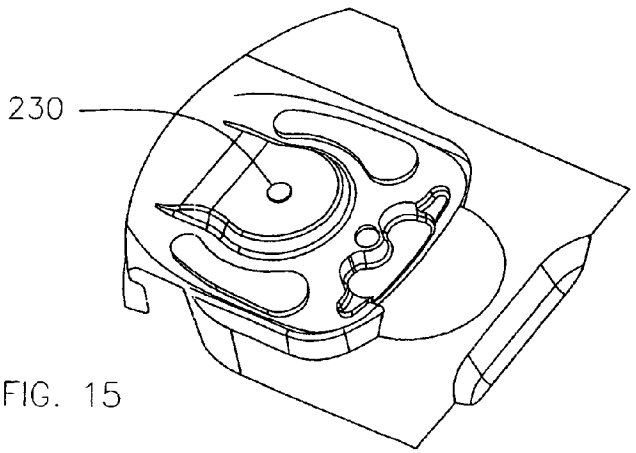
FIG. 15 is a view similar to that of FIG. 14, but with the pull tab in an initial stowed position.

FIGS. 14 and 15 show another pull-tab assembly 200 mounted on a main lid portion 202 of a lid 204. The pull-tab assembly includes a holddown 210 joined by bridges 212 to the pull tab 214. However, the holddown 210 is not joined by a projection and recess to the main lid portion 202, but is joined by a bonded connection. In FIG. 14 the bonded connection is a joining of the regions 222, 224 by adhesive 226. FIG. 15 shows a bonded connection made by welding 230. Welding usually comprises sonic welding although heat welding can be used.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A container with tamper-evident features, the container comprising:

a base;

a lid engageable with the base; and a pull-tab assembly disposed on the lid and including:

a holddown; and a pull tab connected by a breakable joint to the holddown;

a living hinge by which the pull-tab assembly is attached to the lid at a periphery of the lid;

the pull-tab assembly including:

a stowed position in which the pull-tab assembly has been rotated about the living hinge from an initial deployed position to the stowed position, the lid is engaged with the base, the holddown is attached to the lid, the pull tab is attached to the holdown, and the pull tab is under spring biasing away from the lid; and a redeployed position in which the lid is disengageable from the base, the holddown is attached to the lid, and the pull tab is detached from the holdown by breaking of the breakable joints;

the pull-tab assembly being configured such that:

when being placed in the redeployed position from the stowed position by pulling the pull tab away from the holddown, the spring biasing is released and the pull tab pivots with respect the holddown and detaches from the holddown while the holddown remains attached to the lid; and, when in the redeployed position, the pull tab is prevented from being reattached to the holddown, thereby providing evidence of tampering, wherein the lid is not disengageable from the base when the pull-tab assembly is in the stowed position and is disengageable from the base when the pull-tab assembly is in the redeployed position.

2. The container of claim 1, wherein the pull-tab assembly further includes a spring wall configured to contribute spring biasing to cause the pull tab to spring away from the lid when the pull tab is detached from the holddown.

3. The container of claim 1 wherein the pull-tab assembly includes a lock projection disposed on the holddown and a lock recess disposed on the lid for receiving the lock projection.

4. The container of claim 1, wherein the lid and the base form a rounded container.

5. The container of claim 1, wherein the lid and the base have corners and form a square or rectangular container.

6. The container of claim 1, wherein the lid is hinged to the base.

7. The container of claim 1, wherein the pull tab assembly is attached to the lid at a weld spot.

8. A container with tamper-evident features, the container comprising:

a base;

a lid engageable with the base; and a pull-tab assembly disposed on the lid and including:

a holddown; and a pull tab connected by a breakable joint to the holddown;

a living hinge by which the pull-tab assembly is attached to the lid at a periphery of the lid;

the pull-tab assembly including:

a stowed position in which the pull-tab assembly has been rotated about the living hinge from an initial deployed position to the stowed position, the lid is engaged with the base, the holddown is attached to the lid, the pull tab is attached to the holdown, and the pull tab is under spring biasing away from the lid; and a redeployed position in which the lid is disengageable from the base, the holddown is attached to the lid, and the pull tab is detached from the holdown by breaking of the breakable joints;

the pull-tab assembly being configured such that:

when being placed in the redeployed position from the stowed position by pulling the pull tab away from the holddown, the spring biasing is released and the pull tab pivots with respect the holddown and detaches from the holddown while the holddown remains attached to the lid; and, when in the redeployed position, the pull tab is prevented from being reattached to the holddown, thereby providing evidence of tampering, wherein the lid is not disengageable from the base when the pull-tab assembly is in the stowed position and is disengageable from the base when the pull-tab assembly is in the redeployed position, wherein the lid is not hinged to the base.

9. A container with tamper-evident features, the container comprising:

a base:

a lid engageable with the base; and a pull-tab assembly disposed on the lid and including:

a holddown; and a pull tab connected by a breakable joint to the holddown;

a living hinge by which the pull-tab assembly is attached to the lid at a periphery of the lid;

the pull-tab assembly including:

a stowed position in which the pull-tab assembly has been rotated about the living hinge from an initial deployed position to the stowed position, the lid is engaged with the base, the holddown is attached to the lid, the pull tab is attached to the holdown, and the pull tab is under spring biasing away from the lid; and a redeployed position in which the lid is disengageable from the base, the holddown is attached to the lid, and the pull tab is detached from the holdown by breaking of the breakable joints;

the pull-tab assembly being configured such that:

when being placed in the redeployed position from the stowed position by pulling the pull tab away from the holddown, the spring biasing is released and the pull tab pivots with respect the holddown and detaches from the holddown while the holddown remains attached to the lid; and, when in the redeployed position, the pull tab is prevented from being reattached to the holddown, thereby providing evidence of tampering, wherein the lid is not disengageable from the base when the pull-tab assembly is in the stowed position and is disengageable from the base when the pull-tab assembly is in the redeployed position, wherein the lid is hinged to the base.

* * * * *